US009042520B2

(12) United States Patent
Jeong et al.

(10) Patent No.: US 9,042,520 B2
(45) Date of Patent: May 26, 2015

(54) ELECTRIC FIELD EMISSION X-RAY TUBE APPARATUS EQUIPPED WITH A BUILT-IN GETTER

(75) Inventors: Jin Woo Jeong, Daejeon (KR); Jun Tae Kang, Daegu (KR); Yoon Ho Song, Daejeon (KR); Jae Woo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 388 days.

(21) Appl. No.: 13/556,403

(22) Filed: Jul. 24, 2012

(65) Prior Publication Data

US 2013/0028386 A1 Jan. 31, 2013

(30) Foreign Application Priority Data

Jul. 25, 2011 (KR) ..... 10-2011-0073474

(51) Int. Cl.
*H01J 35/04* (2006.01)
*H01J 35/20* (2006.01)
*H01J 35/06* (2006.01)

(52) U.S. Cl.
CPC ..... *H01J 35/04* (2013.01); *H01J 2235/20* (2013.01); *H01J 35/20* (2013.01); *H01J 35/065* (2013.01); *H01J 2235/205* (2013.01)

(58) Field of Classification Search
CPC .. H01J 35/04; H01J 2235/20; H01J 2235/205
USPC ..... 378/119, 121, 122, 123, 136, 137, 138, 378/140
See application file for complete search history.

(56) References Cited

U.S. PATENT DOCUMENTS

| | | | | |
|---|---|---|---|---|
| 5,227,699 | A * | 7/1993 | Busta | 315/291 |
| 5,935,395 | A * | 8/1999 | Ouellet et al. | 204/298.07 |
| 6,259,765 | B1 * | 7/2001 | Baptist | 378/136 |
| 6,816,573 | B2 * | 11/2004 | Hirano et al. | 378/114 |
| 7,526,069 | B2 * | 4/2009 | Matsumura et al. | 378/140 |
| 8,761,344 | B2 * | 6/2014 | Reynolds et al. | 378/138 |
| 2003/0021377 | A1 * | 1/2003 | Turner et al. | 378/102 |
| 2005/0105690 | A1 * | 5/2005 | Pau et al. | 378/145 |
| 2006/0231773 | A1 * | 10/2006 | Katagiri et al. | 250/492.1 |
| 2006/0233307 | A1 * | 10/2006 | Dinsmore | 378/136 |
| 2006/0274889 | A1 * | 12/2006 | Lu et al. | 378/122 |

(Continued)

FOREIGN PATENT DOCUMENTS

| | | | |
|---|---|---|---|
| JP | 2011-081930 | A | 4/2011 |
| KR | 10-0867172 | B1 | 10/2008 |

(Continued)

*Primary Examiner* — Michael Logie
(74) *Attorney, Agent, or Firm* — Rabin & Berdo, P.C.

(57) ABSTRACT

The present disclosure relates to an electric field emission x-ray tube apparatus equipped with a built-in getter, and more particularly, to an electric field emission x-ray tube apparatus equipped with a built-in getter that makes it possible to reduce the size of an x-ray tube by forming a stacked structure, with electric insulation and predetermined gaps maintained for each electrode, by manufacturing an x-ray tube having a stacked structure by inserting insulating spacers (for example, ceramic) between an exhausting port, a cathode, a gate, a focusing electrode, and an anode and bonding them with an adhesive substance, and then inserting a spacer between a field emitter on a cathode substrate and a gate hole connected with a gate electrode.

8 Claims, 2 Drawing Sheets

(56) References Cited

U.S. PATENT DOCUMENTS

| | | | | |
|---|---|---|---|---|
| 2007/0211862 | A1* | 9/2007 | Ito et al. | 378/140 |
| 2008/0057196 | A1* | 3/2008 | Ishikawa et al. | 427/248.1 |
| 2008/0187093 | A1* | 8/2008 | Price et al. | 378/19 |
| 2009/0010393 | A1* | 1/2009 | Klinkowstein et al. | 378/140 |
| 2009/0185660 | A1* | 7/2009 | Zou et al. | 378/122 |
| 2011/0188635 | A1* | 8/2011 | Cho et al. | 378/122 |
| 2012/0250827 | A1* | 10/2012 | Jeong et al. | 378/122 |
| 2013/0022173 | A1* | 1/2013 | Jeong et al. | 378/122 |

FOREIGN PATENT DOCUMENTS

| | | | | |
|---|---|---|---|---|
| KR | 10-2011-0028422 | A | 3/2011 | |
| WO | WO 2009078581 | A2 * | 6/2009 | H01J 35/06 |

* cited by examiner

ELECTRIC FIELD EMISSION X-RAY TUBE APPARATUS EQUIPPED WITH A BUILT-IN GETTER

CROSS-REFERENCE TO RELATED APPLICATIONS

This application is based on and claims priority from Korean Patent Application No. 10-2011-0073474, filed on Jul. 25, 2011, with the Korean Intellectual Property Office, the disclosure of which is incorporated herein in its entirety by reference.

TECHNICAL FIELD

The present disclosure relates to an electric field emission x-ray tube apparatus equipped with a built-in getter, and more particularly, to an x-ray tube apparatus using a spacer that can easily maintain the degree of vacuum, using an activated getter, by applying external voltage to both ends of the getter at the point of time of when the degree of vacuum decreases in an electric field emission x-ray tube apparatus to generate joule heat in the getter to be activated.

BACKGROUND

Common x-ray tubes generate x-rays by hitting electrons against a metal anode target with high energy. For example, an x-ray tube uses a principle of generating Bremstralung x-rays or specific x-rays generated, depending on the substance of the anode target. The electron source that emits electrons is usually a thermal electron source.

Meanwhile, there is an x-ray tube emitting electrons by using nano-substances. The x-ray tube uses a field emitter. It is important in the x-ray tube using a field emitter to apply nano-substances, which are effective for field emission, to a cathode electrode, to form a gate electrode to apply an electric field to the nano-substance, and to seal the structure of the x-ray tube under vacuum.

The x-ray tube using the field emitter decreases in degree of vacuum due to gases exhausted from the inner wall or the field emitter even after the x-ray tube is sealed under vacuum. In order to maintain the degree of vacuum, a getter is disposed in the x-ray tube to maintain the vacuum.

However, there is a problem in that the getter cannot be activated because the getter is mounted in the sealed x-ray tube. That is, it is difficult to activate the getter at the point of time of when the degree of vacuum in the sealed x-ray under vacuum tube decreases.

SUMMARY

The present disclosure has been made in an effort to provide an electric field emission x-ray tube apparatus equipped with a built-in getter that can easily maintain the degree of vacuum, using an activated getter, by applying external voltage to both ends of the getter at the point of time of when the degree of vacuum decreases in an electric field emission x-ray tube apparatus to generate joule heat in the getter to be activated.

An exemplary embodiment of the present disclosure provides an electric field emission x-ray tube apparatus equipped with a built-in getter, including: a cathode configured to emit electrons through a field emitter; a gate configured to apply an electric field to the field emitter through a gate electrode with a gate hole; a focusing electrode configured to focus electrons emitted from the cathode; an anode generating x-rays when the focused electrons hits on an anode target; a getter housing unit configured to activate joule heat in the getter when external voltage is applied to both ends of a getter and maintaining the degree of vacuum by using the activated getter; and a exhausting unit configured to exhaust air between the anode and the getter housing unit through a exhausting pipe, in which the exhausting unit, the getter housing unit, the cathode, the gate, the focusing electrode, and the anode are bonded in a stacked structure by a plurality of spacers such that electric insulation and predetermined gaps are maintained.

According to the exemplary embodiment of the present disclosure, it is possible to easily maintain the degree of vacuum by using an activated getter, by applying external voltage to both ends of the getter at the point of time of when the degree of vacuum decreases to activate the getter by generating joule heat in the getter, in an electric field emission x-ray tube apparatus equipped with a built-in getter. Further, it is possible to easily maintain the degree of internal vacuum by providing a getter-mounting structure in an electric field emission x-ray tube apparatus using a field emitter as an electron source.

Further, it is possible to activate a getter, if necessary, and easily increase the degree of internal vacuum by mounting a nonvolatile getter in a stacked x-ray tube.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
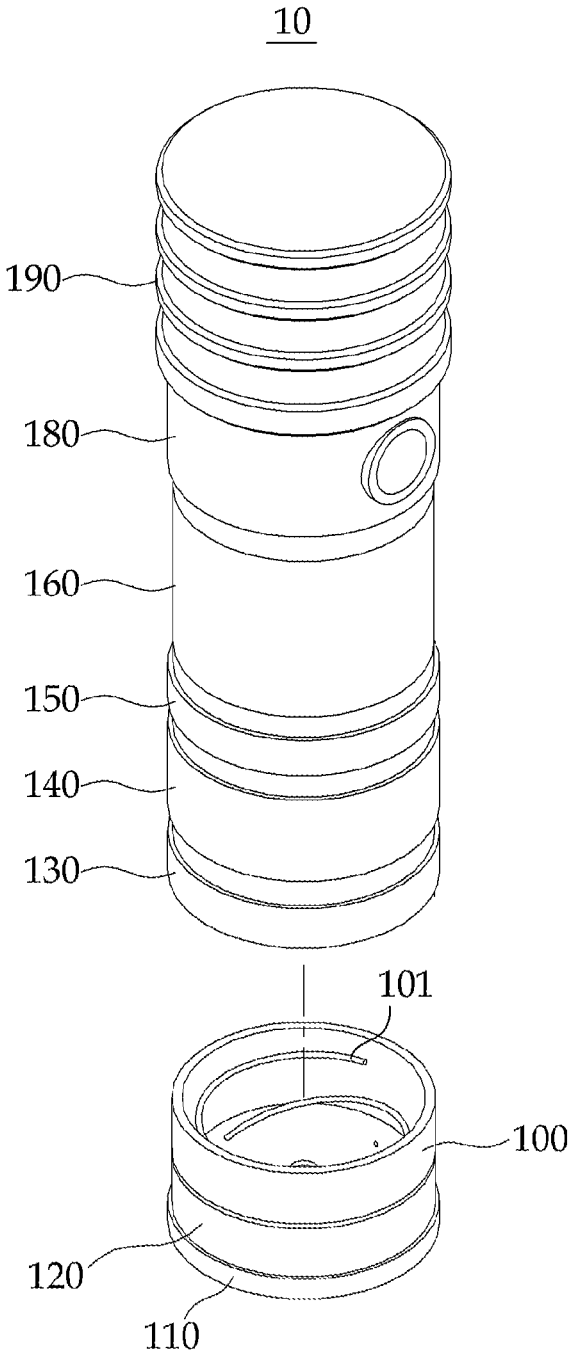
FIG. 1 is an assembly view of an exemplary embodiment of an electric field emission x-ray tube apparatus equipped with a built-in getter according to an exemplary embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings. The configuration and the corresponding operational effect of the present disclosure will be clearly understood through the following detailed description. Before describing in detail the present disclosure, like components are indicated by same reference numerals as much as possible even if they are illustrated in different figures and detailed description of well-known configurations is not provided when it is determined they may make the spirit of the present disclosure unclear.

FIG. 1 is an assembly view of an exemplary embodiment of an electric field emission x-ray tube apparatus equipped with a built-in getter according to an exemplary embodiment of the present disclosure.

As illustrated in FIG. 1, an x-ray tube apparatus 10 according to an exemplary embodiment of the present disclosure includes an exhausting unit 110, spacer units 120, a cathode 130, a gate 140, a first focusing electrode 150, a second focusing electrode 160, an x-ray inducing unit 180, an anode 190, and a getter housing unit 100. The x-ray tube apparatus 10 has a stacked structure with the parts bonded by a plurality of spacer units 120.

It is important to maintain the degree of internal vacuum in the x-ray tube apparatus 10 using a field emitter. The degree of vacuum is decreased by gases emitted from the inner wall or the field emitter, after the x-ray tube apparatus 10 is sealed under vacuum. When the degree of vacuum of the x-ray tube apparatus 10 decreases, the life span of the field emitter may decrease due to being damaged caused by hitting of ions or arc. Further, when damage to the field emitter is serious, it cannot be repaired, such that the x-ray tube apparatus 10 may not operate. The getter housing unit 100 includes a getter 101 and can maintain the degree of vacuum in the x-ray tube apparatus 10 by using the getter 101.

The cathode 130, gate 140, first focusing electrode 150, and second focusing electrode 160, which are electrode parts, are stacked by the spacer units 120. In the x-ray tube apparatus 10 having the structure in which the connecting portions are bonded under vacuum, as described above, a nonvolatile getter 101 is mounted between the exhausting unit 110 at the lower end where a exhausting pipe is disposed and the electrode of the getter housing unit 100 electrically separated by the spacer unit 120.

For example, a strip-shaped nonvolatile getter 101 may be mounted in the x-ray tube apparatus 10. The strip-shaped nonvolatile getter 101 activates a getter substance sticking on the surface by generating joule heat when voltage is applied to both getter ends. The nonvolatile getter 101 can increase the degree of vacuum by adsorbing the internal contaminating gases while the getter substance is activated.

Figure 2:
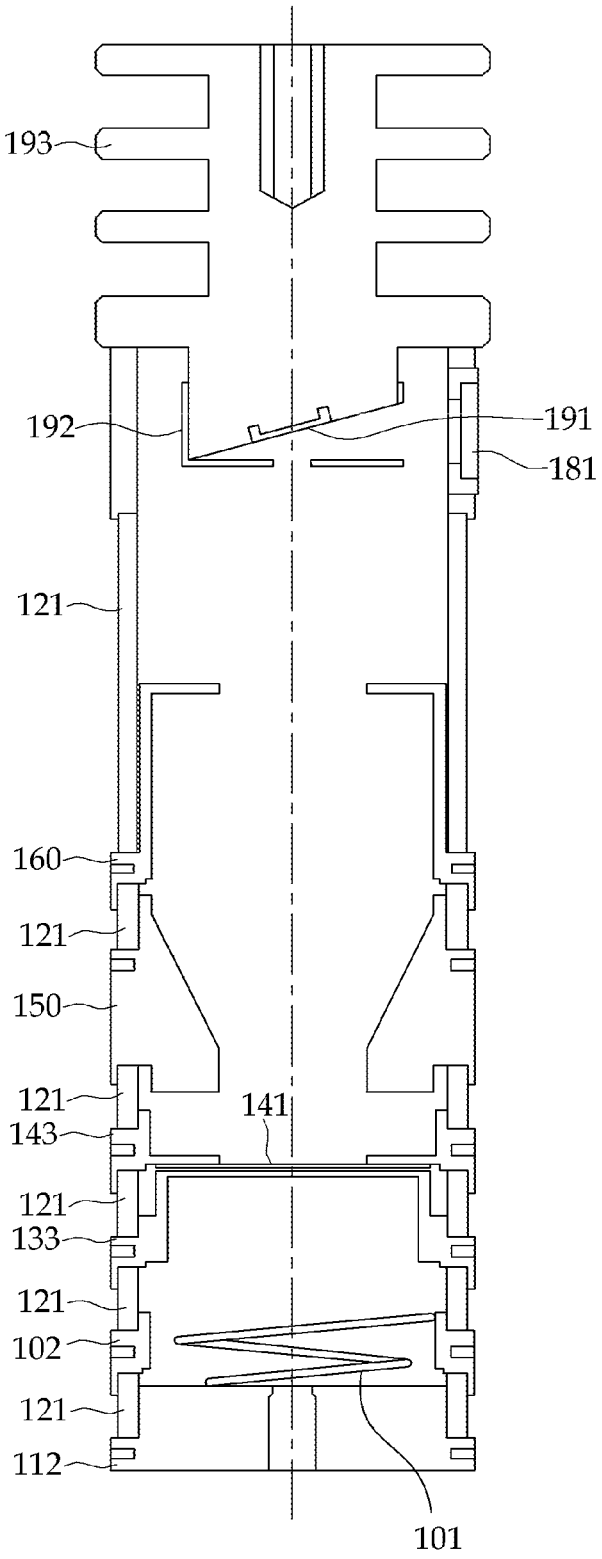
FIG. 2 is cross-sectional view of an exemplary embodiment of an electric field emission x-ray tube apparatus equipped with a built-in getter according to an exemplary embodiment of the present disclosure.

FIG. 2 is cross-sectional view of an exemplary embodiment of an electric field emission x-ray tube apparatus equipped with a built-in getter according to an exemplary embodiment of the present disclosure.

The anode 190 includes an anode target 191 and an anode electrode 193. Further, the anode 190 may include an anti-back scattering cap 192 with a small hole passing electrons. The anti-back scattering cap 192 is provided to prevent back scattering of electrons hitting the anode target 191.

X-rays generated from the anode target 191 are induced to the outside of the x-ray tube through a window 181 made of beryllium or the like.

The air in the space between the gate electrode 143 and the anode electrode 193 is exhausted through the exhausting pipe 100 after passing through exhausting holes formed at the gate electrode 14 and the cathode electrode 133.

For the cathode 130, the gate 140, or the first and second focusing electrodes 150 and 160, an insulating spacer 121 prevents the charge from stacking due to the hitting of the electrons by reducing the exposed area of the inner surface of the insulating spacer 121 as much as possible while maintaining a sufficient gap between the electrodes.

The getter housing unit 100 includes an external power connection tap 102 at the electrode of the getter housing unit 100 to be able to apply voltage to both ends of the getter 101 from the outside, if necessary. The power connection tap 102 is connected with both sides of the getter 101 and used to activate the getter 101 at the point of time of when the degree of internal vacuum of the x-ray tube apparatus 10 sealed under vacuum decreases. As the getter 101 is activated, the degree of vacuum of the x-ray tube apparatus 10 can be maintained. The power connection tap 102 facilitates connection with an external power source.

According to the present disclosure, it is possible to easily maintain the degree of vacuum by using an activated getter, by applying external voltage to both ends of the getter at the point of time of when the degree of vacuum decreases to activate the getter by generating joule heat in the getter, in an electric field emission x-ray tube apparatus equipped with a built-in getter. Therefore, it is possible to not only sufficiently put apparatuses where the present disclosure is applied on the market or do business, but use the present disclosure for the related technologies, beyond the existing technical limit, and actually and definitely achieve the present disclosure, such that the present disclosure may be considered to have industrial applicability.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An electric field emission x-ray tube apparatus equipped with a built-in getter, comprising:

a cathode configured to emit electrons through a field emitter;

a gate configured to apply an electric field to the field emitter through a gate electrode with a gate hole;

a focusing electrode configured to focus electrons emitted from the cathode;

an anode generating x-rays when the focused electrons hits on an anode target;

a getter;

a getter housing unit configured to activate joule heat in the getter when external voltage is applied to both ends of the getter and maintaining the degree of vacuum by using the activated getter; and an exhausting unit configured to exhaust air between the anode and the getter housing unit through an exhausting pipe, wherein the exhausting unit, the getter housing unit, the cathode, the gate, the focusing electrode, and the anode are stacked in this order and are bonded together by a plurality of spacers such that electric insulation and predetermined gaps are maintained, wherein the getter is mounted in the getter housing unit that is placed under the cathode, and wherein the getter has a strip shape.

2. The apparatus of claim 1, wherein the getter housing unit receives external voltage by both ends of the getter which are connected with electrically separated electrodes.

3. The apparatus of claim 1, wherein the getter housing unit further includes a power connection tap for applying external voltage to both ends of the getter.

4. The apparatus of claim 1, wherein the getter is a nonvolatile getter.

5. The apparatus of claim 1, wherein:

the focusing electrode includes a first electrode and a second electrode, and the spacers include a first spacer between the gate and the first electrode and a second spacer between the first electrode and the second electrode, the first spacer has an outer circumferential surface exposed to an outside, a lower surface in contact with the gate and an upper surface in contact with the first electrode, and the second spacer has an outer circumferential surface exposed to the outside, a lower surface in contact with the first electrode and an upper surface in contact with the second electrode.

6. The apparatus of claim 5, wherein the first electrode includes:

a first outer circumferential surface exposed to the outside, an upper surface extending inward from the first circumferential surface and in contact with the lower surface of the second spacer, and a second outer circumferential surface extending upward from the upper surface and covering and in contact with an inner circumferential surface of the second spacer.

7. The apparatus of claim 5, wherein the spacers further include a third spacer between the second electrode and the anode, and the third spacer includes an outer circumferential surface exposed to the outside, a lower surface in contact with the second electrode, and an inner circumferential surface.

8. The apparatus of claim 7, wherein the second electrode includes:

a first outer circumferential surface exposed to the outside, an upper surface extending inward from the first circumferential surface and in contact with the lower surface of the third spacer, and a second outer circumferential surface extending upward from the upper surface and covering and in contact with the inner circumferential surface of the third spacer.

* * * * *